US006260291B1

(12) United States Patent
Farys

(10) Patent No.: US 6,260,291 B1
(45) Date of Patent: Jul. 17, 2001

(54) SPORTS FOOTWEAR FOR CYCLING USE

(75) Inventor: Yves Farys, Saint-Jorioz (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/403,049

(22) PCT Filed: Jan. 14, 1999

(86) PCT No.: PCT/FR99/00053

§ 371 Date: Oct. 26, 1999

§ 102(e) Date: Oct. 26, 1999

(87) PCT Pub. No.: WO99/44455

PCT Pub. Date: Sep. 10, 1999

(30) Foreign Application Priority Data

Mar. 2, 1998 (FR) ..... 98 02869

(51) Int. Cl.[7] ..... A43B 5/00
(52) U.S. Cl. ..... 36/131; 36/107; 36/108
(58) Field of Search ..... 36/131, 107, 108

(56) References Cited

U.S. PATENT DOCUMENTS

| | | | | |
|---|---|---|---|---|
| 3,841,005 | * | 10/1974 | Cox | 36/76 C |
| 4,272,897 | * | 6/1981 | Ponce | 36/24.5 |
| 4,404,757 | * | 9/1983 | Sweeny | 36/107 |
| 4,825,565 | * | 5/1989 | Bigolin | 36/131 |
| 4,893,420 | * | 1/1990 | Bezin et al. | 36/131 |
| 5,125,173 | * | 6/1992 | Nagano et al. | 36/131 |
| 5,131,291 | | 7/1992 | Beyl . | |
| 5,205,056 | | 4/1993 | Shinpei et al. . | |
| 5,685,093 | * | 11/1997 | Lin | 36/131 |
| 5,687,492 | | 11/1997 | Muraoka . | |
| 5,704,138 | | 1/1998 | Donnadieu . | |
| 5,845,421 | * | 12/1998 | Tanaka | 36/117.3 |

FOREIGN PATENT DOCUMENTS

| | | |
|---|---|---|
| 0521287 | 1/1993 | (EP) . |
| 0553934 | 8/1993 | (EP) . |
| 0749704 | 12/1996 | (EP) . |
| 2405037 | 5/1979 | (FR) . |
| 2620002 | 3/1989 | (FR) . |
| WO 96/10346 | 4/1996 | (WO) . |

* cited by examiner

*Primary Examiner*—Paul T. Sewell
*Assistant Examiner*—Troy Arnold
(74) *Attorney, Agent, or Firm*—Greenblum & Bernstein, P.L.C.

(57) ABSTRACT

Sports footwear for cycling use, in which a latching member is provided to cooperate with a bicycle pedal and is detachably attached to the sole with a rigid insert. The footwear of the invention includes a sole and an upper extending upwardly from the sole. A reinforcement plate is fixed on an upper surface of the sole and is positioned beneath the peripheral edge of the upper. Further, an insole is positioned above the peripheral edge of the upper, the peripheral edge thereby being situated between the insole and the reinforcement plate, with the thickness of the peripheral edge of said upper defining a housing. The rigid insert has an upper portion that is adjustably positioned on an upper surface of the reinforcement plate, the upper portion of the rigid insert having a thickness no greater than the height of the housing defined by the thickness of the peripheral edge of the upper. The latching member is detachably connected to the insert.

21 Claims, 2 Drawing Sheets

3
3a
e
9
7
1
P
8
10
11
2
12
II
5
P
15
9
3a
16
13
4
6

3
3a
P
5a
5
7
8
10
13
11
2
4
II
6
2a
2b

SPORTS FOOTWEAR FOR CYCLING USE

BACKGROUND OF THE INVENTION

1. The Field of the Invention

The instant invention is related to a cycling boot or shoe of the type comprising a latching plate or wedge adapted to cooperate with a pedal adapted to a bicycle. The latching of the plate on the pedal occurs automatically in a known manner.

Generally, this plate is detachably attached on the sole by means of a position adjustable rigid insert, integrated to the sole, the plate being mounted on the insert by screws or other attachment elements.

2. Description of Background and Relevant Information

French Patent Application No. 2 620 002 describes a wedge or plate the aforementioned type adapted to a boot in whose sole is housed an insert on which the wedge adapted to cooperate with the pedal is screwed.

This application discloses a device that requires an allowance or recess to be made in the sole adapted to house the insert and the wedge, thereby requiring, as indicated in this application, a sole thickness that is greater than that of normal cycling boots.

This also has the drawback of spacing the cyclist's foot with respect to the pedal, thereby reducing the sensitivity and efficiency of the force exerted on the pedal. In addition, the reinforced thickness of the sole necessarily increases its weight.

Also known, according to French Patent Application No. 2 405 037, is a boot whose sole is molded around a previously stamped and formed metallic core. The insert on which the wedge is screwed is arranged in a reinforcement of the metallic core.

This also has the drawback of spacing the insert, and thereby the plate, from the cyclist's foot, as mentioned previously, with the resulting consequences, because the sole remains very thick and the insert is positioned very low in it.

In addition, according to this device, it becomes necessary to block the slots of the insert adapted to affix the wedge during the sole injection operation, so as to keep them from becoming clogged.

In fact, the problem that needs to be solved with respect to devices known in the art consists of finding an arrangement for the insert adapted to affix the wedge in which it remains as close as possible to the user's foot so as to optimize efficiency. Also sought is the optimum weight/rigidity ratio, i.e., finding a sole that has maximum rigidity while having minimum thickness and weight.

SUMMARY OF THE INVENTION

It is the object of the instant invention to solve the problems posed hereinabove and, to this end, the invention is related to a cycling boot or shoe of the type comprising an upper, a sole and a latching wedge or plate adapted to cooperate with a pedal adapted to a bicycle and detachably attached to the sole by means of a position adjustable rigid insert integrated to the sole, and on which the insert is mounted said wedge by affixing members, such as screws. The insert adapted to affix the wedge is integrated to the sole by means of a sole reinforcement plate that it crosses through and that is fixed on the inner surface thereof, in order to constitute a sub-assembly on which an insole is fixedly attached after the intercalation of a peripheral edge for the boot upper, whose thickness defines an assembly setting volume, within which is housed the insert having a substantially corresponding thickness, so as to be located as close as possible to the cyclist's foot, in order to optimize the efficiency of the force on a pedal.

In this way, according to the invention, the insert adapted to affix the wedge is located immediately behind the insole, and therefore, except for this, almost in contact with the cyclist's foot and metatarsophalangeal articulation zone. In fact, the insert and, as a result, the axle of the pedal, could not be arranged any closer to the cyclist's foot, thereby reducing undesirable torques, and thus maximizing the efficiency of the force exerted on the pedal.

Furthermore, the advantage of the solution can be found in the fact that the sole thickness is reduced as much as possible because its rigidity is obtained by the presence of the reinforcement plate which is not duplicate molded but fixed thereupon, thereby avoiding the overthicknesses that are necessary when this reinforcement plate is, on the contrary, embedded, as known in the prior art.

The instant invention is also related to the characteristics that will become apparent from the following description, and these should be considered both singly and according to all possible technical combinations thereof.

BRIEF DESCRIPTION OF THE DRAWINGS

This description, which is provided as a non-restrictive example, will provide a better understanding of how the invention can be obtained, with reference to the annexed drawings in which.

DETAILED DESCRIPTION OF THE INVENTION

Figure 1:
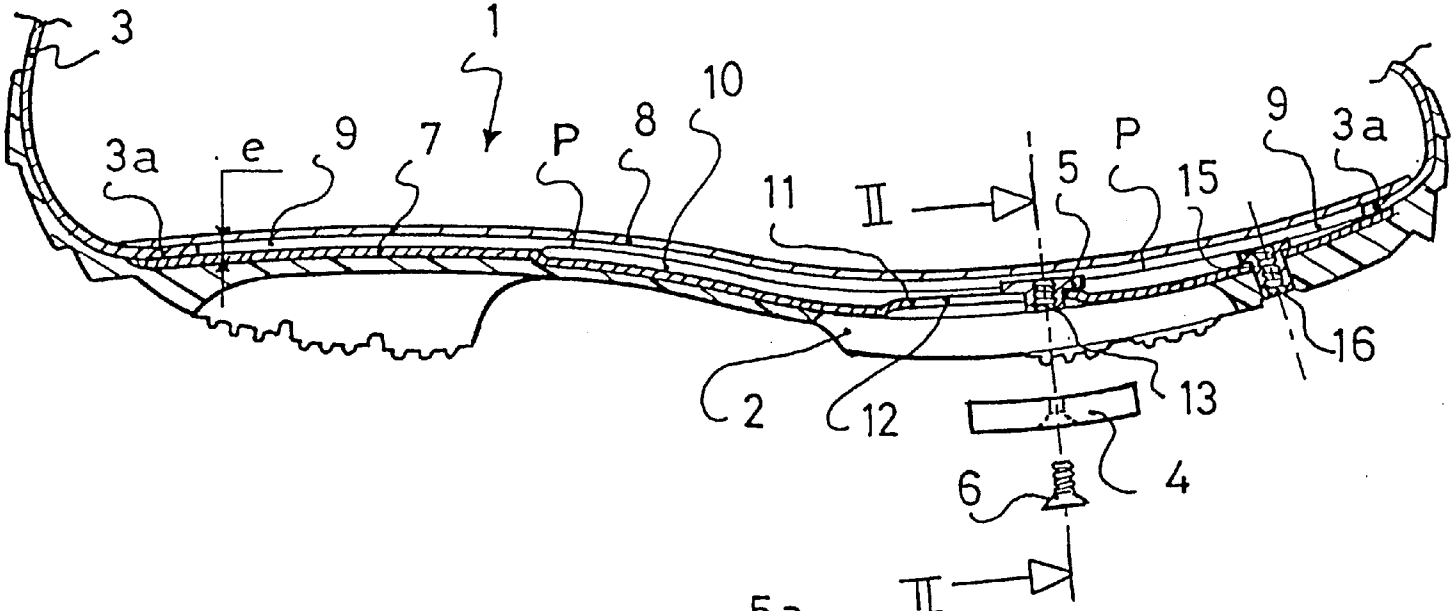
FIG. 1 is a longitudinal cross-sectional view of a cycling boot according to the invention.

The cycling boot 1, designated in its entirety in FIG. 1, is constituted in a known manner of a sole 2, on which an upper 3 is mounted and, on the lower surface of which a latching wedge or member 4 is mounted adapted to cooperate with a pedal (not shown) adapted to a bicycle. This wedge 4, in the form of a small plate or body is attached to the sole 2 in a detachable manner, by means of a position adjustable rigid insert 5, and integrated to the sole 2, the wedge 4 being mounted on such insert 5 by means of affixing elements, such as screws 6. Thus, as explained below, the insert 5 is constituted of a plate-like upper portion 5*a* having a substantially rectangular shape equipped with two threaded cylinders 13 extending from the upper 5*a* of the insert 5. The cycling boot 1 is assembled in a traditional manner, i.e., the upper 2 is mounted on a form (not shown in the drawing) by means of an insole 8, and the assembly is then glued onto the sole 2.

Figure 2:
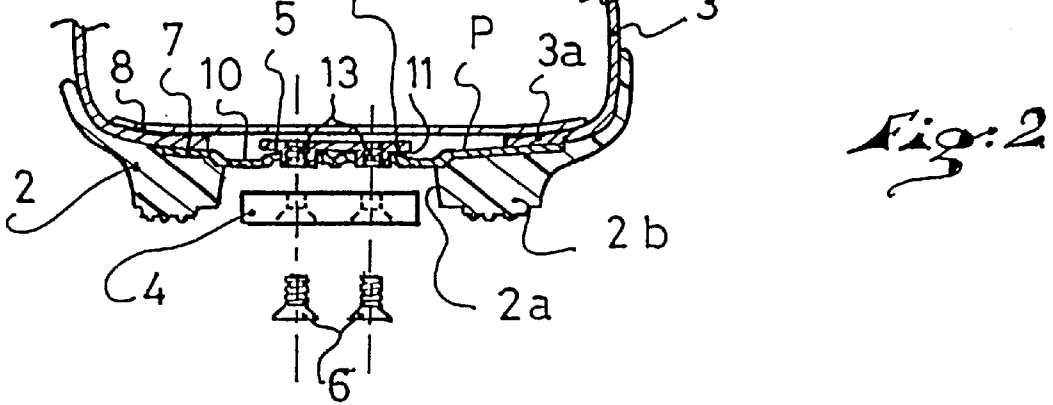
FIG. 2 is a transverse cross-sectional view along the line II—II of FIG. 1.

The pedal of the bicycle has not been represented and the wedge 4 is only shown schematically because these are well known. As seen in both FIGS. 1 and 2 of the drawings, in the preferred embodiment the "wedge" does not have a tapered thickness. The sole 2 is equipped on its upper surface with a reinforcement plate 7 extending along the major portion of the sole 2 and is fixed, for example, by gluing, onto the sole 2, and the insert 5 adapted to affix the wedge 4 is integrated to the sole 2 by means of the reinforcement plate 7 of the sole 2 through which it extends by its threaded cylinders 13, its upper plate-shaped portion 5*a* remaining pressed against the upper surface of the sole 2.

During the assembly, this sub-assembly constituted of the sole 2, the reinforcement 7 and the insert 5 is glued to the upper 3/insole 8 assembly, with the intercalation of a peripheral edge 3*a* of a lower portion of the upper 3 of the boot 1 being glued to this same insole 8, and known by the term "assembly setting".

The thickness "e" of the peripheral edge 3*a* defines, along with insole 8 and the sole 2, a housing or volume 9 of the so-called assembly setting within which is housed, in the metatarsophalangeal articulation zone, the upper portion 5*a* of the insert 5. The upper portion 5*a* of the insert 5 has a thickness that corresponds substantially to the thickness, or height, "e" of the setting assembly volume 9. As a result, the insert and consequently the wedge 4 which is fixed on top, are located as close as possible to the cyclist's foot, thereby eliminating undesirable torques and optimize the efficiency of the forces exerted on the pedal.

Preferably, the sole 2 is equipped in its central zone with a large recess 2*a* and, in fact, only has a peripheral edge 2*b*, comprising walking pads or cleats, as the case may be, and the reinforcement plate 7 is partially visible under the sole 2 through the recess 2*a*, at least in the metatarsal zone, in which the support on the pedal occurs. The advantage of this construction is that it ensured better sliding when the pedal is actuated with respect to traditional plastic soles, when the reinforcement 7 is metallic, because it is on such reinforcement that the sliding takes place during the actuation.

According to another characteristic of the invention, the reinforcement plate 7 of the sole 2 comprises, in a localized manner, in predetermined zones, stiffening elements 10, so that the plate 7 can be made from a material having very little thickness, and thus very little weight, and yet provide equivalent rigidity.

Figure 3:
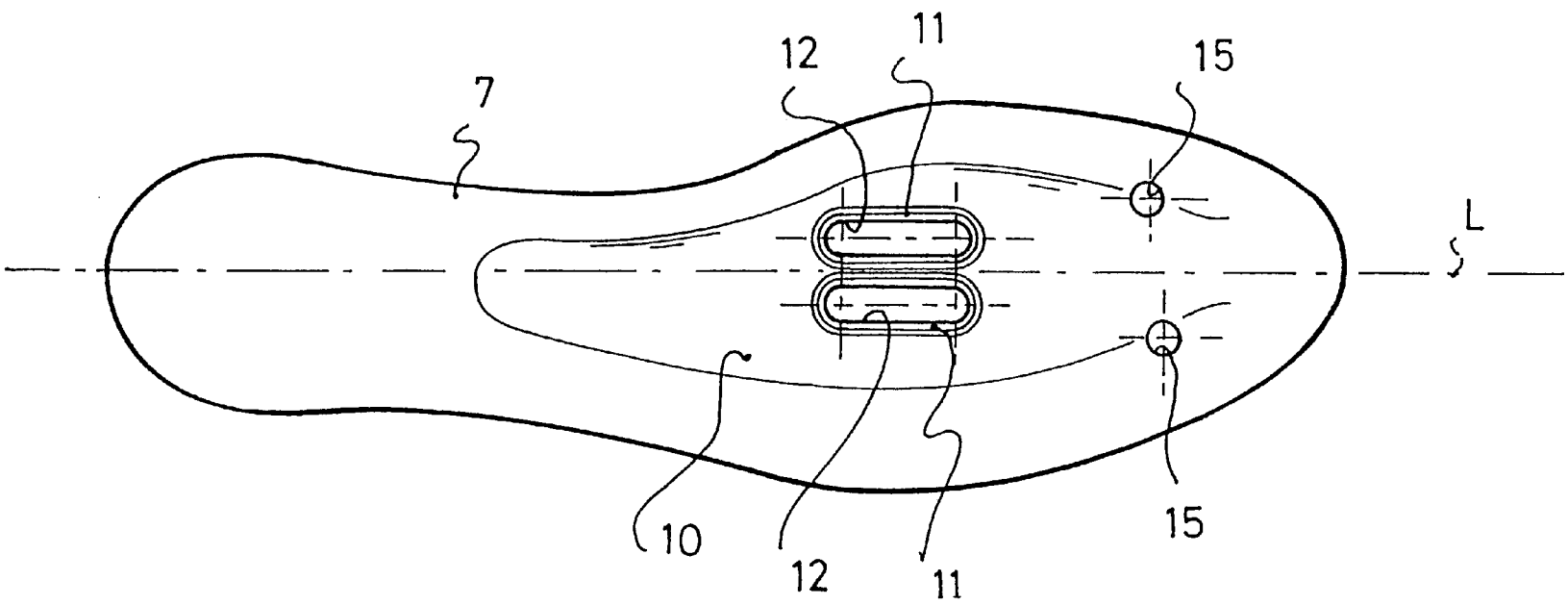
FIG. 3 is a plan view of a reinforcement plate such as the one used in the composition of the boot according to FIG. 1.

As shown in FIG. 3, these stiffening elements 10 are constituted primarily by a rib extending longitudinally along a central zone of the reinforcement plate 7 extending substantially from the rear end of the plantar arch up to the tip of the sole 2.

As shown in FIG. 1, this rib 10, which constitutes a first stiffening element, is made by a localized deformation of the reference plane P of the reinforcement plate 7, defined by a longitudinal hump directed downwardly, with respect to the plane of the boot 2.

According to one embodiment, the longitudinal hump forming the rib 10 of the reinforcement plate 7 is made by embossing a metallic blank that constitutes it.

In this case, a high performance aluminum alloy would be preferable because it is a material that has the advantage of being light and rust-proof, and it ages well.

The use of a reinforcement 7 made of aluminum alloy also has the advantage, with respect to traditional plastic soles, of reducing caking, i.e., the accumulation of dirt against the sole, especially while using a dirt bike, and is thus especially advantageous.

According to a potential variation, the longitudinal rib 10 of the reinforcement plate 7 is obtained during the same molding operation of the plastic material constituting it.

In the latter case, the material could be filled with reinforcing fibers.

According to another characteristic of the invention, the longitudinal hump or stiffening rib 10 of the reinforcement plate 10, directed downwardly, is counter-deformed upwardly in a localized manner in the metatarsal zone where the insert 5 adapted to affix the wedge 4 is housed, in order to constitute a planar hump 11 that corresponds substantially to the reference plane P of the original plate 7, and that is crossed through by two longitudinal slots 12 arranged symmetrically with respect to the longitudinal axis of the sole, so as to allow, on the one hand, the insert 5 to be housed in the free volume 9 having a free thickness "e" defined by the assembly setting 3*a* and as close as possible to the insole 8 and, on the other hand, to allow the two threaded barrels 13 originating therefrom to cross through the slots 12 obtained in the planar hump 11 of the reinforcement plate 7, with a view to affixing the wedge 4 by screws 6 after adjusting the position of the wedge in the longitudinal slots 12.

Preferably, the counter-deformation constituting the planar hump 11 is made by a double embossing made about each of the longitudinal slots 12 so as to increase the rigidity.

It should be noted that the surface evenness of the hump 11 along which the insert 5 can be displaced so as to adjust the position of the wedge 4, is particularly interesting because it allows such an adjustment to occur while keeping the height of said wedge constant with respect to the sole, or in other words, it maintains a constant difference in height between said wedge 4 and the heel support, which is not the case in known soles in which any variation in position of the wedge in the longitudinal direction causes a variation in position of the height thereof, which is linked to the curvature of the sole in the area of the affixing zone of said wedge.

Furthermore, the reinforcement plate 7 comprises, in predetermined zones, inserts 15 that are force fitted therein and extend through the sole by the threaded barrels 16 adapted to affix the cramps (not shown).

It should also be noted that the use of a metallic reinforcement 7 is interesting for the spring effect that it can provide, which improves the efficiency and perceptions of the cyclist.

Naturally, the instant invention is adapted to all bicycle applications, and especially to road bikes, city bikes, dirt bikes, etc.

It is also applicable to any boot in which similar or equivalent problems need resolution.

What is claimed is:

1. A cycling shoe comprising:

a sole;

an upper extending upwardly from said sole, a lower portion of said upper having a peripheral edge, said peripheral edge having a determinate thickness;

a reinforcement plate fixed on an upper surface of said sole and being positioned beneath said peripheral edge of said upper;

an insole positioned above said peripheral edge of said upper, said peripheral edge of said upper thereby being situated between said insole and said reinforcement plate, said thickness of said peripheral edge of said upper defining a housing, said housing having a determinate height;

a rigid insert having an upper portion adjustably positioned on an upper surface of said reinforcement plate, said upper portion of said rigid insert having a thickness no greater than said determinate height of said housing defined by said thickness of said peripheral edge of said upper;

a latching member, adapted to cooperate with a pedal of a bicycle, said latching member being detachably connected to said insert.

2. A cycling shoe according to claim 1, wherein:

said reinforcement plate comprises a plurality of stiffening elements extending in predetermined areas of said reinforcement plate, said predetermined areas comprising less than an entirety of said reinforcement plate.

3. A cycling shoe according to claim 2, wherein:

said stiffening elements comprise ribs extending longitudinally in a central zone of said reinforcement plate substantially from a plantar arch zone to a front end zone of the sole.

4. A cycling shoe according to claim 3, wherein:

said reinforcement plate extends generally along a reference plane and said ribs comprise deformations of said plate in the form of humps extending longitudinally and downwardly from said reference plane.

5. A cycling shoe according to claim 4, wherein:

said reinforcement plate is made from a metal blank and said humps are made by embossing said metal blank.

6. A cycling shoe according to claim 4, wherein:

said reinforcement plate is made of plastic and said humps are made unitary with a remainder of said reinforcement plate in a molding step during manufacture of said reinforcement plate.

7. A cycling shoe according to claim 4, wherein:

each of said downwardly extending humps is counter-deformed upwardly to form a planar hump extending substantially in said reference plane;

each of said humps contains a longitudinally extending slot;

said rigid insert comprises threaded cylinders extending from said upper portion of said rigid insert through respective ones of said longitudinally extending slots; and screws extend through said latching member and are threaded in respective ones of said threaded cylinders for connecting said latching member to said insert.

8. A cycling shoe according to claim 7, wherein:

said reinforcement plate is made from a metal blank and said humps are made by embossing said metal blank around each of said longitudinally extending slots.

9. A cycling shoe according to claim 1, further comprising:

inserts force-fitted in determinate areas of said reinforcement plate, said inserts extending through said sole by means of threaded cylinders, said threaded cylinders being adapted to affix cleats to said sole.

10. A cycling shoe according to claim 1, further comprising:

inserts force-fitted in determinate areas in a metatarsal zone of said reinforcement plate, said inserts extending through said sole by means of threaded cylinders, said threaded cylinders being adapted to affix cleats to said sole.

11. A cycling shoe comprising:

an upper having a lower portion, said lower portion of said upper having a peripheral edge, said peripheral edge having a determinate thickness;

an insole affixed above said peripheral edge of said upper to form an insole/upper assembly;

a sub-assembly comprising:

a sole a reinforcement plate affixed above an upper surface of said sole;

a rigid insert having an upper portion positioned on an upper surface of said reinforcement plate;

said sub-assembly being fixed to said insole/upper assembly, whereby said reinforcement plate is fixed beneath said peripheral edge of said upper, an insert housing being defined between said insole and said reinforcement plate and having a height equal to said determinate thickness of said peripheral edge of said upper, said upper portion of said insert being housed in said insert housing;

a latching wedge, adapted to cooperate with a pedal of a bicycle, said latching wedge being detachably connected to said insert.

12. A cycling shoe according to claim 11, wherein:

said insole/upper assembly is assembly set to said sub-assembly, whereby said reinforcement plate is affixed to said upper surface of said sole with glue and said insole is affixed to said peripheral edge of said upper with glue, and said insert housing is formed as an assembly setting volume.

13. A cycling shoe according to claim 11, wherein:

said reinforcement plate comprises a plurality of stiffening elements extending in predetermined areas of said reinforcement plate, said predetermined areas comprising less than an entirety of said reinforcement plate.

14. A cycling shoe according to claim 13, wherein:

said stiffening elements comprise ribs extending longitudinally in a central zone of said reinforcement plate substantially from a plantar arch zone to a front end zone of the sole.

15. A cycling shoe according to claim 14, wherein:

said reinforcement plate extends generally along a reference plane and said ribs comprise deformations of said plate in the form of humps extending longitudinally and downwardly from said reference plane.

16. A cycling shoe according to claim 15, wherein:

said reinforcement plate is made from a metal blank and said humps are made by embossing said metal blank.

17. A cycling shoe according to claim 15, wherein:

said reinforcement plate is made of plastic and said humps are made unitary with a remainder of said reinforcement plate in a molding step during manufacture of said reinforcement plate.

18. A cycling shoe according to claim 15, wherein:

each of said downwardly extending humps is counter-deformed upwardly to form a planar hump extending substantially in said reference plane;

each of said humps contains a longitudinally extending slot;

said rigid insert comprises threaded cylinders extending from said upper portion of said rigid insert through respective ones of said longitudinally extending slots; and screws extend through said latching member and are threaded in respective ones of said threaded cylinders for connecting said latching member to said insert.

19. A cycling shoe according to claim 18, wherein:

said reinforcement plate is made from a metal blank and said humps are made by embossing said metal blank around each of said longitudinally extending slots.

20. A cycling shoe according to claim 11, further comprising:

inserts force-fitted in determinate areas of said reinforcement plate, said inserts extending through said sole by means of threaded cylinders, said threaded cylinders being adapted to affix cleats to said sole.

21. A cycling shoe according to claim 11, further comprising:

inserts force-fitted in determinate areas in a metatarsal zone of said reinforcement plate, said inserts extending through said sole by means of threaded cylinders, said threaded cylinders being adapted to affix cleats to said sole.

* * * * *